US005396038A

United States Patent [19]

Yamada

[11] Patent Number: 5,396,038

[45] Date of Patent: Mar. 7, 1995

[54] THIN KEYBOARD SWITCH

[75] Inventor: Kazunori Yamada, Tokyo, Japan

[73] Assignee: SMK Co., Ltd., Tokyo, Japan

[21] Appl. No.: 168,989

[22] Filed: Dec. 17, 1993

Related U.S. Application Data

[63] Continuation of Ser. No. 898,447, Jun. 15, 1992, abandoned.

[51] Int. Cl.[6] ..... H01H 3/12

[52] U.S. Cl. ..... 200/517; 200/344; 200/345

[58] Field of Search ..... 200/345, 344, 517, 302.2

[56] References Cited

U.S. PATENT DOCUMENTS

| | | | |
|---|---|---|---|
| 3,367,206 | 2/1968 | Moody | 200/345 X |
| 4,556,769 | 12/1985 | Inaba | 200/345 |
| 5,120,923 | 6/1992 | Kato et al. | 200/517 X |
| 5,145,058 | 9/1992 | Lee | 200/517 |

FOREIGN PATENT DOCUMENTS

| | | | |
|---|---|---|---|
| 267541 | 5/1988 | European Pat. Off. | 200/344 |
| 3405652 | 8/1985 | Germany | 200/344 |
| 589635 | 1/1978 | U.S.S.R. | 200/302.2 |

*Primary Examiner*—Renee S. Luebke

*Attorney, Agent, or Firm*—Harold L. Burstyn; Thomas R. Morrison

[57] ABSTRACT

A key stem of a keyboard switch includes an outer slide and an inner slide. When a key top is struck, the outer slide slides inside of an outer guide, and the inner slide slides inside an inner guide. A first moment point is developed between the outer slide and the outer guide, while a second moment point is developed between the inner slide and the inner guide. A taper at the bottom of the outer slide prevents the second moment point being developed in that location. The reduced horizontal distance between the two moment points helps prevent binding of the key when an actuating force is applied off the axis of the key top. A relationship is disclosed for avoiding sticking or binding in which the horizontal distance between the two moment points, times a coefficient of friction, is less than the vertical distance between the planes of the two moment points.

7 Claims, 2 Drawing Sheets

THIN KEYBOARD SWITCH

This is a continuation of application Ser. No. 07/898,447, filed on Jun. 15, 1992, now abandoned.

BACKGROUND OF THE INVENTION

The present invention relates to thin keyboard switches and, in particular, to a thin keyboard switch whose key stem moves up and down smoothly when the key is struck at its edge rather than at its center.

Generally, a conventional thin keyboard switch has an upper printed circuit board, an insulating spacer, and a lower printed circuit board. The pair of printed circuit boards and the insulating spacer are stacked like a sandwich on an insulating base. A pair of contacts, one fixed, and one moveable, attached respectively to the upper and lower printed circuit boards face each other within a cavity in the insulating spacer. On the upper printed circuit board sits a housing above which a key top is attached by an elastic coupling such as a coil spring.

A key stem is attached to the underside of the key top. The center of the key stem is a sliding body that slides within a guiding body shaped as a cylindrical shell with a space through its center. Fastening portions under the key top engage fastening portions outside the guiding body to limit the travel of the key.

When this conventional key is struck at its edge, it does not move smoothly. It may in fact catch, bind, or stick in its travel up and down. The conventional key catches, binds, or sticks because the distance of vertical key travel is smaller than the horizontal distance between the points about which the key top rocks if it is struck at the edge. That is, when the key is struck at its edge rather than at its center, a moment is created that adds a rotational component to the key's downward motion. (The point through which this moment acts will hereinafter be called the "moment point".)

OBJECT AND SUMMARY OF THE INVENTION

An object of the present invention is to provide a thin keyboard switch that overcomes the drawbacks of the prior art.

A further object of the present invention is to provide a thin keyboard switch that moves up and down smoothly when a key is struck at the edge of a key top rather than at the center.

Still a further object of the present invention is to provide a thin keyboard switch that moves up and down without catching, sticking, or binding when a key is struck at its edge top rather than at its center.

Briefly stated, the present invention provides a key stem of a keyboard switch having an outer slide and an inner slide. When a key top is struck, the outer slide slides inside of an outer guide, and the inner slide slides inside an inner guide. A first moment point is developed between the outer slide and the outer guide, while a second moment point is developed between the inner slide and the inner guide. A taper at the bottom of the outer slide prevents the second moment point being developed in that location. The reduced horizontal distance between the two moment points helps prevent binding of the key when an actuating force is applied off the axis of the key top. A relationship is disclosed for avoiding sticking or binding in which the horizontal distance between the two moment points, times a coefficient of friction, is less than the vertical distance between the planes of the two moment points.

According to an embodiment of the invention, there is provided a thin keyboard switch comprising: a key having a proximal and a distal edge, a key top, and a housing, the key having further a key stem terminating in a pressure portion, an inner slide and an outer slide attached to the key stem, mounted on the housing, an inner guide and an outer guide within which the inner slide and the outer slide move down and up, whereby the pressure portion switches a circuit on and off, the key having further a first moment point about which a force couple acts located where the outer slide contacts the outer guide, the key having further a second moment point about which the force couple acts located where the inner slide contacts the inner guide, and a vertical distance between the first and the second moment points is greater than the product of a horizontal distance between the first moment point and the proximal edge multiplied by a coefficient of friction.

According to a feature of the invention, there is provided a thin keyboard switch comprising: a key having a proximal and a distal edge, the key having further a key stem, an inner slide and an outer slide attached to the key stem, means for switching a circuit on and off by striking the key, means for moving the key up and down cooperating with the means for switching, the key having a first moment point about which a force couple acts located where the outer slide contacts an outer guide affixed to a housing of the key, the key having further a second moment point about which the force couple acts located where the inner slide contacts an inner guide affixed to the housing, and $h > \mu l_1$, where h is a vertical distance between the first and the second moment points, $l_1$ is a horizontal distance between the proximal edge and the first moment point, and $\mu$ is a coefficient of friction.

According to a further feature of the invention, there is provided a thin keyboard switch comprising: a guide, a slide slidable in the guide, a key top affixed to the slide, means for permitting the slide to displace axially within the guide, the slide forming a first moment point between itself and the slide in response to an off-center force on the key top, means for preventing the slide forming a second moment point between itself and the guide in response to the off-center force on the key top, and means for forming the second moment point at a horizontal distance substantially less than a horizontal distance between the first moment point and a point diametrically opposite the first moment point between the guide and the slide.

The present invention comprises the following features. A keyboard switch can be turned on by striking a key top, thereby driving a key stem to close a circuit by bringing a movable contact, on a flexible membrane, into electrical contact with a fixed contact, mounted on an insulating base. A pair of circular bodies, an inner slide and an outer slide, are mounted concentrically on the key stem. An inner guide and an outer guide are attached to a housing so that the inner slide and the outer slide can move up and down within them. The dimensions of the key top, the sliding bodies, and the other components are such that $h > \mu l_1$, where h is a vertical distance between the moment points of an inner slide and an outer slide respectively, $\mu$ is a coefficient of friction, and $l_1$ is a horizontal distance between a moment point of an outer slide and the point on the edge of a key top where it is struck.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
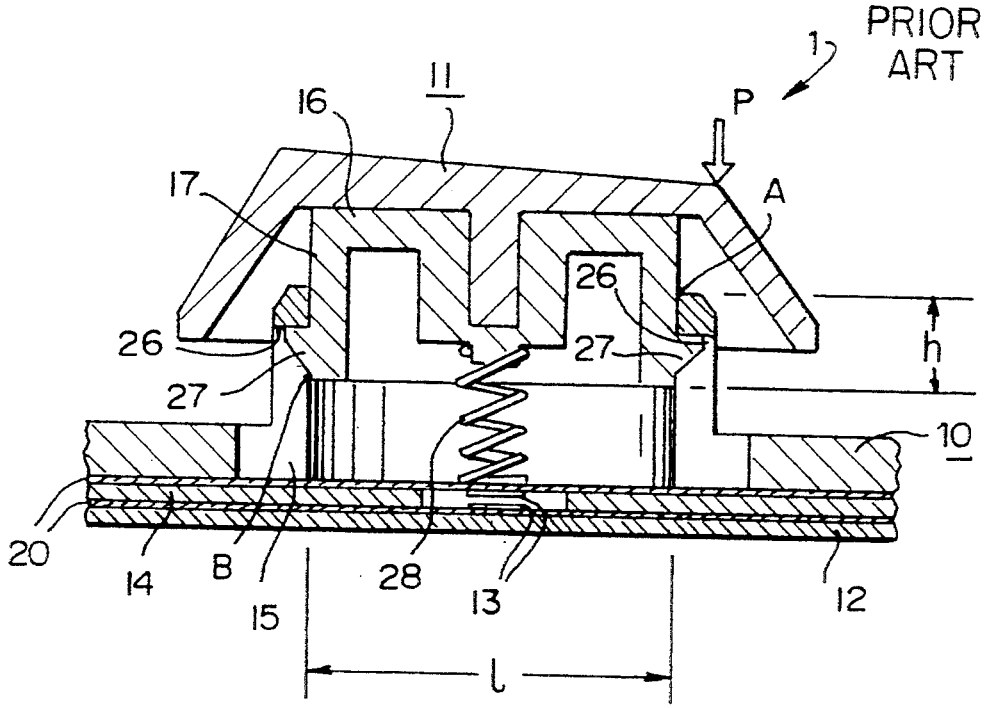
FIG. 1 is a sectional plan view of a conventional key known in the art.

Referring to FIG. 1, a thin keyboard switch 1 according to the prior art generally has a pair of upper and lower printed circuit boards 20. Upper and lower printed circuit boards 20 are separated by an insulating spacer 14. Upper and lower printed circuit boards 20 and insulating spacer 14 are mounted on an insulating base 12. Insulating spacer 14 has a cavity at its center. A movable and a fixed contact 13 are attached to respective printed circuit boards 20 so that they face each other across the cavity in insulating space 14. A housing 10 sits atop upper printed circuit board 20. A key top 11 is attached to housing 10 through an elastic coupling 28, which may be a coil spring.

A guiding body 15 is fixed to housing 10. Guiding body 15 is a cylindrical shell with a central cavity. Guiding body 15 has two fastening portions 26 at its upper end, symmetrically disposed with respect to the center of the cavity, and spaced apart at an angle of 180 degrees with respect to each other. A key stem 16 is attached to the underside of key top 11. The center of key stem 16 is a sliding body 17 which moves vertically within guiding body 15. A fastening portion 27 projects from sliding body 17 to engage fastening portion 26, thereby limiting the vertical travel of key stem 16.

When a point P at a proximal edge of key top 11 is struck in the direction shown by an arrow, moment points about which the force of the keystroke acts to rotate key top 11 are a closest moment point A and a farthest moment point B. In a conventional thin keyboard switch 1, a vertical distance h between the plane of A and the plane of B is smaller than a horizontal distance L between A and B. The moment between A mid B causes a rotation of key top 11, so it does not move smoothly when the edge of key top 11 is struck. Keyboard switch 1 may catch, bind, or stick as it moves vertically.

Figure 2:
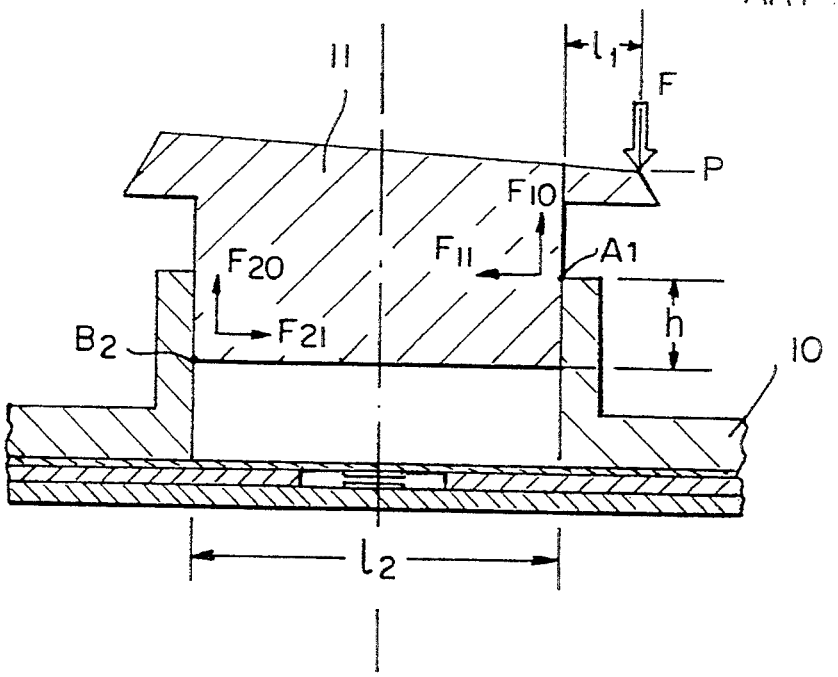
FIG. 2 is a schematic view of the prior-art key.

Referring to FIG. 2, the dynamics of the prior-art key are as follows. When a point P is struck with a force F, the following equations describe the forces acting on moment points $A_1$ and $B_2$. In these equations, h is a vertical distance between $A_1$ and $B_2$, $\mu$ is a coefficient of friction, $l_1$ is the horizontal distance between point P and the proximal edge of key stem 16, $l_2$ is the horizontal distance between $A_1$ and $B_2$, $F_{11}$ is the horizontal and $F_{10}$ the vertical component of the moment of force F about moment point $A_1$, and $F_{21}$ is the horizontal and $F_{20}$ the vertical component of the moment of force F about moment point $B_2$.

$$hF_{11}+l_2F_{10}=(l_1+l_2)F \quad (1)$$

$$F_{10}=\mu F_{11} \quad (2)$$

$$F_{20}=\mu F_{21} \quad (3)$$

$$F_{11}=F_{21} \quad (4)$$

From (1) and (2), $$F_{11}=F(l_1+l_2)/(\mathrm{H}+\mu l_2) \quad (5)$$

Figure 3:
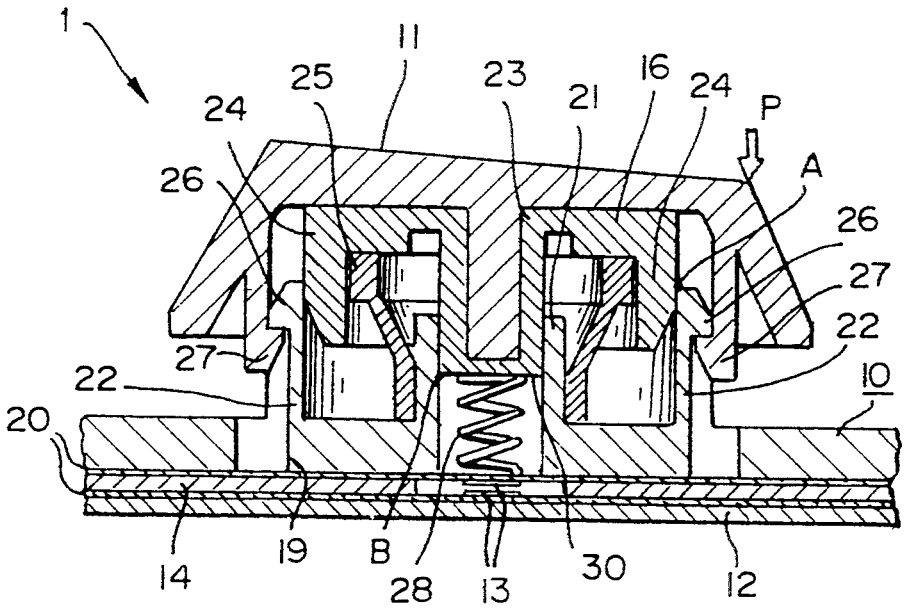
FIG. 3 is a sectional plan view of an embodiment of a key of the present invention.

Referring to FIG. 3, a keyboard switch 1 of the present invention has a different configuration. An insulating spacer 14 separates upper printed circuit board 20 from lower printed circuit board 20. Upper and lower printed circuit boards 20 and insulating spacer 14 are mounted on an insulating base 12. Insulating spacer 14 has a cavity at its center. A movable and a fixed contact 13 are attached to respective upper and lower printed circuit boards 20 so that they face each other across the cavity in insulating space 14. A housing 10 sits atop upper printed circuit board 20. A key top 11 is attached to housing 10 by elastic coupling 25, which may be a coil spring, a rubber tube, or the like.

An inner guide 21 in the shape of a cylindrical shell with a space through its center is affixed to housing 10 on the upper side thereof. An outer guide 22, also in the shape of a cylindrical shell, surrounds inner guide 21. Outer guide 22 has a much larger diameter than inner guide 21. The upper edge of outer guide 22 terminates in fastening portion 26 around the outside circumference thereof.

Key stem 16 is fitted beneath key top 11. The central portion of key stem 16 is an inner slide 23 that is slidably fitted into inner guide 21. The external portion of key stem 16 is an outer slide 24 that is slidably fitted into outer guide 22. The lower part of outer slide 24 is tapered to avoid permitting farthest moment point B from occurring at this location. Moment point A is located where outer slide 24 meets outer guide 22. Moment point B is located where a contact pressure portion 30 at the bottom of inner slide 23 meets inner guide 21 at the portion of keyboard switch 1 distal to the edge of key top 11 that is struck. That is, moment point B is displaced toward moment point A by the provision of inner slide 23 and inner guide 21, compared to the prior art device of FIGS. 1 and 2. The vertical separation between A and B, which is vertical distance h, is made as large as possible to give key top 11 the maximum stroke.

Elastic coupling 28, which can be a coil spring, a rubber tube, or the like, is attached between upper printed circuit board 20 and contact pressure portion 30 at the inside of inner guide 21. Fastening portions 27, projecting downward from key top 11, engage fastening portions 26 to limit the travel of key top 11 and key stem 16.

In the above structure, when key top 11 is first depressed, outer slide 24 slides downward inside outer guide 22 and inner slide 23 slides downward inside inner guide 21. A thin-walled portion 19 of an elastic body 25 is compressed to give a click feel. When key top 11 is further depressed, contact pressure portion 30 compresses elastic coupling 28. The key switch is activated when the movable contact 13 is brought into contact with the fixed contact 13 under pressure from contact pressure portion 30. When key top 11 is further depressed after the key switch is activated, the operator receives a strong feeling of a stroke. When pressure is removed from key top 11, key top 11 is returned to its original position by the elastic rebound of elastic coupling 28 and elastic body 25.

Figure 4:
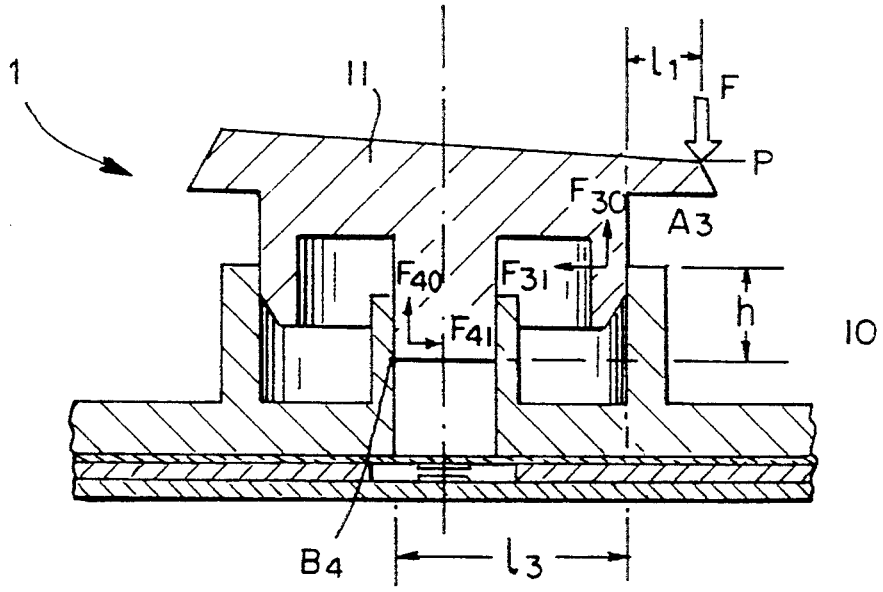
FIG. 4 is a schematic view of the embodiment of FIG. 3.

Referring to FIG. 4, the dynamics of keyboard switch 1 of the present invention are different from the prior art. When point P is struck with force F, the following equations describe the forces acting on moment points $A_3$ and $B_4$. In these equations, h, $\mu$, and $l_1$ are the same as in equations (1) through (5), $l_3$ is the horizontal distance between $A_3$ and $B_4$, $F_{31}$ is the horizontal and $F_{30}$ the vertical component of the moment of force F about moment point $A_3$, and $F_{41}$ is the horizontal and $F_{40}$ the vertical component of the moment of force F about moment point $B_4$.

$$hF_{31}+l_3F_{30}=(l_1+l_3)F \quad (6)$$

$$F_{30}=\mu F_{31} \quad (7)$$

$$F_{40}=\mu F_{41} \quad (8)$$

$$F_{31}=F_{41} \quad (9)$$

From (6) and (7), $$F_{31}=F(l_1+l_3)/(h+\mu l_3) \quad (10)$$

For the key switch of the present invention to be more effective in suppressing binding, sticking, or catching than the prior art, the following two conditions must be satisfied:

$$F_{41}<F_{21}$$

$$F_{31}<F_{11}.$$

These two conditions are really one and the same, since $F_{21}=F_{11}$ from (4) and $F_{31}=F_{41}$ from (9). If the condition is satisfied, substitution from (5) and (10) gives:

$$F(l_1+l_3)/(h+\mu l_3)<F(l_1+l_2)/(h+\mu l_2)$$

Multiplying out and collecting terms, $$h(l_3-l_2)<\mu l_1(l_3-l_2),$$

or $F_{31}<F_{11}$ (and $F_{41}<F_{21}$) implies $$(l_3-l_2)(h-\mu l_1)<0. \quad (11)$$

Comparing FIG. 2 with FIG. 4, it is obvious that $l_2>l_3$. This is true because moment point B has been displaced toward moment point A by the taper at the bottom of outer slide 24, and the provision of inner slide 23 and inner guide 21 between which moment point B is developed. Thus the expression on the left side of equation (11) can be negative if and only if $h>\mu l_1$. Therefore the key switch of the present invention moves smoothly without catching, binding, or sticking when $h>\mu l_1$.

In summary, the present invention is a keyboard switch 1 that is turned on and off at a fixed and a movable contact 13 on insulating base 12 by key stem 16 in response to applying and releasing pressure on key top 11. Inner slide 23 and outer slide 24, each in the shape of a concentric circle, are attached to key stem 16. On housing 10 near the movable contact 13, inner guide 21 and outer guide 22, within which inner slide 23 and outer slide 24 can move up and down, are respectively attached. Keyboard switch 1 of the present invention is effective for insuring smooth movement and eliminating sticking, catching, or binding if and only if the condition $h>\mu l_1$ is satisfied, where h is a vertical distance between moment points $A_3$ and $B_4$ of inner slide 23 and outer slide 24, $\mu$ is a coefficient of friction, and 11 is a horizontal distance between moment point $A_3$ of outer slide 24 and the proximal edge of key top 11. When key top 11 is struck on its edge, the key moves up and down smoothly and does not catch, stick, or bind as it does so.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A thin key switch comprising:

a key cap having a top surface;

a housing;

an inner slide, having a first proximal end and a first distal end, attached at said first proximal end to a one of said key cap and said housing;

an outer slide having a second proximal end and a second distal end, attached at said second proximal end to said one of said key cap and said housing;

said inner slide having a center axis substantially parallel to a direction of movement of said inner slide;

an inner guide rigidly attached to an other of said key cap and said housing;

an outer guide rigidly attached to said other of said key cap and said housing;

said inner slide being slidably inserted in said inner guide;

said outer slide being slidably inserted in said outer guide;

a switch in said other of said key cap and said housing;

said inner slide actuating said switch when said inner slide is moved in said direction of movement;

each of said inner slide and said outer slide being substantially cylindrical in shape with a continuous outer surface;

said outer slide surrounding a portion of said inner slide;

an elastic boot having a first end connected to said key cap and having a second end connected to said housing;

a first portion of said elastic boot having a substantially larger diameter than a second portion of said elastic boot;

said elastic boot being positioned between said inner guide and said outer guide;

a first inner surface of said inner guide;

a second inner surface of said outer guide; and said outer slide being shaped to prevent said second distal end from pressing against said inner surface upon a tilting of said key cap, whereby said first distal end contacts said first inner surface and thereby causes said inner slide, rather than said outer slide, to resist said tilting.

2. A thin key switch comprising:

a key cap having a top surface;

a housing;

an inner slide, having a first proximal end and a first distal end, attached at said first proximal end to a one of said key cap and said housing;

an outer slide, having a second proximal end and a second distal end, attached at said second proximal end to said one of said key cap and said housing;

said inner slide having a center axis substantially parallel to a direction of movement of said inner slide;
an inner guide rigidly attached to an other of said key cap and said housing;
an outer guide rigidly attached to said other of said key cap and said housing;
said inner slide being slidably inserted in said inner guide;
said outer slide being slidably inserted in said outer guide;
a switch in said other of said key cap and said housing;
said inner slide actuating said switch when said inner slide is moved in said direction of movement; each of said inner slide and said outer slide being substantially cylindrical in shape with a continuous outer surface;
said outer slide surrounding a portion of said inner slide;
an outer point on said top surface at a radial distance from said center axis;
means for returning said key cap to a home position;
a first inner surface of said inner guide;
a second inner surface of said outer guide; and
said outer slide being shaped to prevent said second distal end from pressing against said second inner surface upon a tilting of said key cap, whereby said inner slide makes contact with said first inner surface, thereby causing said inner slide, rather than said outer slide, to resist said tilting.

3. Apparatus as in claim 1, further comprising:
an elastic boot having a first end connected to said key cap and a second end connected to said housing;
a first portion of said elastic boot having a substantially larger diameter than a second portion of said elastic boot;
said elastic boot being positioned between said inner guide and said outer guide; and
said key cap including a portion overhanging said outer slide and said outer guide.

4. Apparatus as in claim 2, further comprising:
an elastic boot having a first end connected to said key cap and a second end connected to said housing;
a first portion of said elastic boot having a substantially larger diameter than a second portion of said elastic boot; and
said elastic boot being positioned between said inner guide and said outer guide.

5. Apparatus as in claim 2, wherein said key cap includes a portion overhanging said outer slide and said outer guide.

6. A thin key switch comprising:
a key cap having a top surface;
a housing;
an inner slide, having a first proximal end and a first distal end, attached at said first proximal end to a one of said key cap and said housing;
an outer slide, having a second proximal end and a second distal end, attached at said second proximal end to said one of said key cap and said housing;
said inner slide having a center axis substantially parallel to a direction of movement of said inner slide;
an inner guide rigidly attached to an other of said key cap and said housing;
an outer guide rigidly attached to said other of said key cap and said housing;
said inner slide being slidably inserted in said inner guide;
said outer slide being slidably inserted in said outer guide;
an inner surface of said inner guide;
a switch in said other of said key cap and said housing;
said inner slide including means for actuating said switch when said inner slide is moved in said direction of movement;
an outer point on said top surface at a radial distance from said center axis;
said outer slide pressing against said outer guide at it first moment point on said outer guide when an external force is applied to said outer point;
means for returning said key cap to a home position when said external force is removed from said key cap; and
said outer slide having a bevel shape at said second distal end, whereby said first distal end of said inner slide presses against said inner surface of said inner guide at a second moment point on said inner surface when said external force is applied to said outer point.

7. A thin key switch comprising:
a key top;
a housing;
an inner slide, having a first proximal end and a first distal end, attached at said first proximal end to said key top;
an inner guide attached to said housing;
an outer slide, having a second proximal end and a second distal end, attached at said second proximal end to said key top;
an outer guide attached to said housing;
said inner slide being slidably inserted in said inner guide;
said outer slide being slidably inserted in said outer guide;
a switch in said housing;
said inner slide having means for actuating said switch when said key top is pressed toward said housing;
means for urging said key top away from said housing;
said outer slide surrounding at least in part a portion of said inner slide;
a first inner surface of said inner guide;
a second inner surface of said outer guide; and
said outer slide being shaped to prevent said second distal end from pressing against said second inner surface upon a tilting of said key top, whereby said first distal end contacts said first inner surface, thereby causing said inner slide, rather than said outer slide, to resist said tilting.

* * * * *